US007096701B1

(12) United States Patent
Peterson

(10) Patent No.: US 7,096,701 B1
(45) Date of Patent: Aug. 29, 2006

(54) WHEEL RIM ROLLING APPARATUS FOR USE IN PRODUCING A VEHICLE WHEEL RIM

(75) Inventor: Gary L. Peterson, Sedalia, MO (US)

(73) Assignee: Hayes Lemmerz International, Inc., Northville, MI (US)

( * ) Notice: Subject to any disclaimer, the term of this patent is extended or adjusted under 35 U.S.C. 154(b) by 68 days.

(21) Appl. No.: 10/982,181

(22) Filed: Nov. 5, 2004

Related U.S. Application Data

(60) Provisional application No. 60/517,781, filed on Nov. 6, 2003.

(51) Int. Cl.
*B21D 15/04* (2006.01)

(52) U.S. Cl. ..... 72/105; 72/10.1; 72/13.4; 72/31.08

(58) Field of Classification Search ..... 72/10.1, 72/13.4, 13.5, 13.6, 31.08, 31.11, 105; 33/706, 33/710, 784
See application file for complete search history.

(56) References Cited

U.S. PATENT DOCUMENTS 3,775,012 A * 11/1973 Ling et al. ..... 356/625
4,909,683 A * 3/1990 Kopidlowski et al. ..... 409/218
5,044,186 A * 9/1991 Taylor et al. ..... 72/31.08
5,560,238 A * 10/1996 Allebach et al. ..... 72/13.4
6,732,559 B1 * 5/2004 Gasparini ..... 72/31.1
6,973,738 B1 * 12/2005 Kaneda et al. ..... 33/636

* cited by examiner

*Primary Examiner*—Ed Tolan
(74) *Attorney, Agent, or Firm*—MacMillan, Sobanski & Todd, LLC

(57) ABSTRACT

This invention relates to an improved wheel rim rolling apparatus for use in producing a vehicle wheel rim. The wheel rim rolling apparatus includes a top roll assembly having upper rim tools adapted to engage a rim blank or a partially formed rim in order to impart a desired shape thereto, a moveable member and a non-moveable member. The upper rim tools are carried by the moveable member. A first position indicating member is attached to one of the moveable member and the non-moveable member of the top roll assembly. The first position indicating member is operative to generate a visual or readable output signal which is used for determining the position of the upper rim tools of the top roll assembly. A second position receiving member is attached to the other one of the moveable member and the non-moveable member of the top roll assembly. The second member is adapted to receive the visual or readable output signal from the first member to thereby indicate the position of the upper rim tools.

17 Claims, 4 Drawing Sheets

WHEEL RIM ROLLING APPARATUS FOR USE IN PRODUCING A VEHICLE WHEEL RIM

CROSS-REFERENCE TO RELATED APPLICATIONS

This application claims the benefit of U.S. Provisional Application Ser. No. 60/517,781, filed Nov. 6, 2003.

BACKGROUND OF THE INVENTION

This invention relates in general to vehicle wheels and in particular to an improved wheel rim rolling apparatus for use in producing a vehicle wheel rim.

A conventional vehicle wheel is typically of a two-piece construction and includes an inner wheel disc and an outer "full" wheel rim. The wheel disc can be cast, forged, or fabricated from steel, aluminum, or other alloys, and includes an inner annular wheel mounting portion and an outer annular portion. The wheel mounting portion of the wheel disc defines an inboard mounting surface and includes a center pilot or hub hole, and a plurality of lug receiving holes formed therethrough for mounting the vehicle wheel to an axle of the vehicle. The wheel rim is fabricated from steel, aluminum, or other alloys, and includes an inboard tire bead seat retaining flange, an inboard tire bead seat, an axially extending well, an outboard tire bead seat, and an outboard tire bead seat retaining flange. In some instances, a three-piece wheel construction having a mounting cup secured to the wheel disc is used. In both types of constructions, the outer annular portion of the wheel disc is secured to the wheel rim by a weld.

A full face wheel is distinguished from other types of wheels by having a one-piece wheel disc construction. In particular, the full face wheel includes a "full face" disc and a "partial" rim. The full face disc can be formed cast, forged, or fabricated from steel, aluminum, or other alloys. The full face disc includes an inner annular wheel mounting portion and an outer annular portion which defines at least a portion of an outboard tire bead seat retaining flange of the wheel. The wheel mounting portion defines an inboard mounting surface and includes a center pilot or hub hole, and a plurality of lug receiving holes formed therethrough for mounting the wheel to an axle of the vehicle. The partial rim is fabricated from steel, aluminum, or other alloys, and includes an inboard tire bead seat retaining flange, an inboard tire bead seat, an axially extending well, and an outboard tire bead seat. In some instances, the outboard tire bead seat of the rim and the outer annular portion of the disc cooperate to form the outboard tire bead seat retaining flange of the full face wheel. In both types of constructions, the outboard tire bead seat of the rim is positioned adjacent the outer annular portion of the disc and a weld is applied to secure the rim and the disc together.

SUMMARY OF THE INVENTION

This invention relates to an improved wheel rim rolling apparatus for use in producing a vehicle wheel rim. The wheel rim rolling apparatus includes a top roll assembly having upper rim tools adapted to engage a rim blank or a partially formed rim in order to impart a desired shape thereto, a moveable member and a non-moveable member. The upper rim tools are carried by the moveable member. A first position indicating member is attached to one of the moveable member and the non-moveable member of the top roll assembly. The first position indicating member is operative to generate a visual or readable output signal which is used for determining the position of the upper rim tools of the top roll assembly. A second position receiving member is attached to the other one of the moveable member and the non-moveable member of the top roll assembly. The second member is adapted to receive the visual or readable output signal from the first member to thereby indicate the position of the upper rim tools.

Other advantages of this invention will become apparent to those skilled in the art from the following detailed description of the preferred embodiments, when read in light of the accompanying drawings.

DESCRIPTION OF THE PREFERRED EMBODIMENTS

Figure 1:
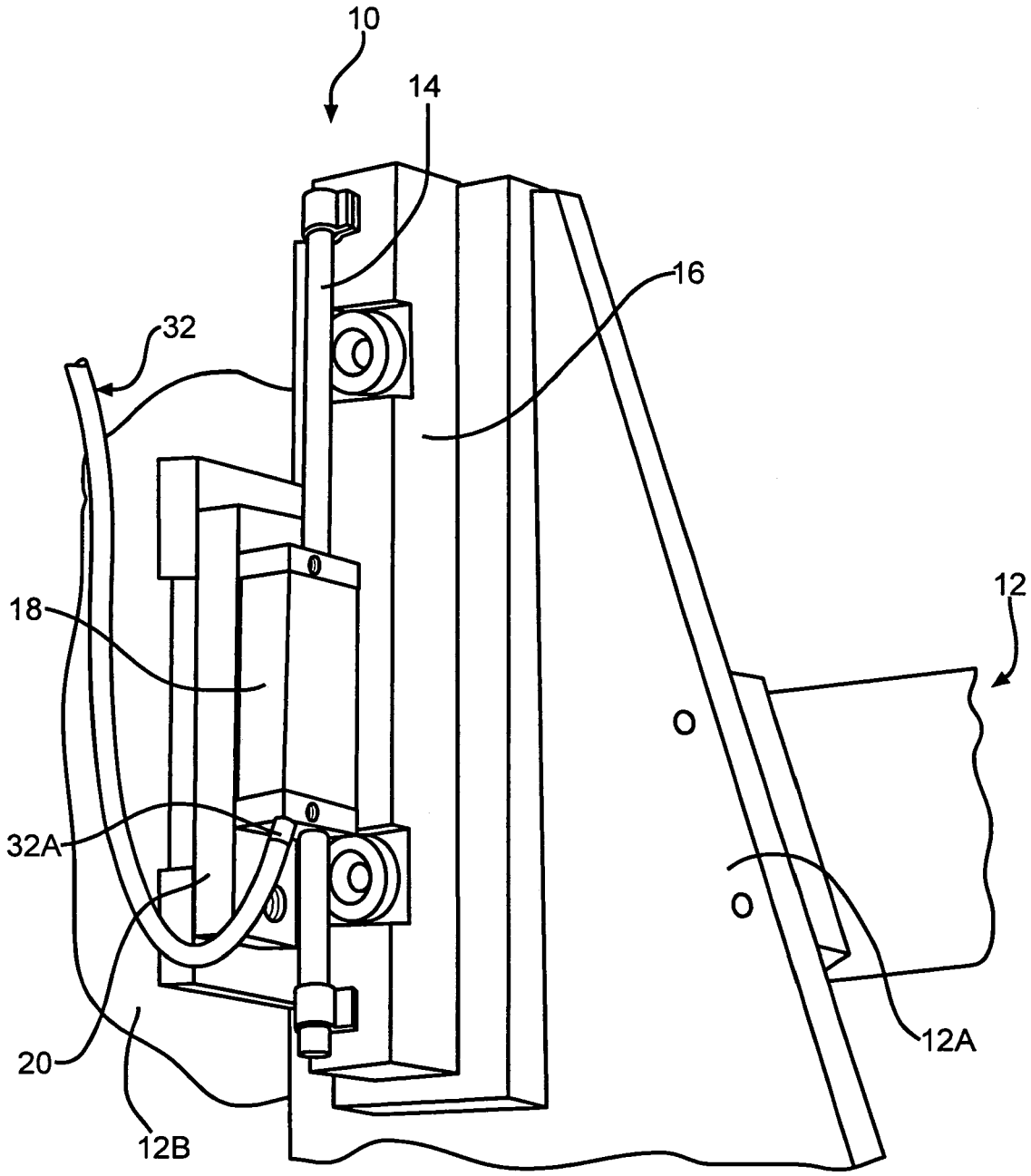
FIG. 1 is a view of a portion of a first embodiment of a rim rolling apparatus in accordance with the present invention.
Figure 3:
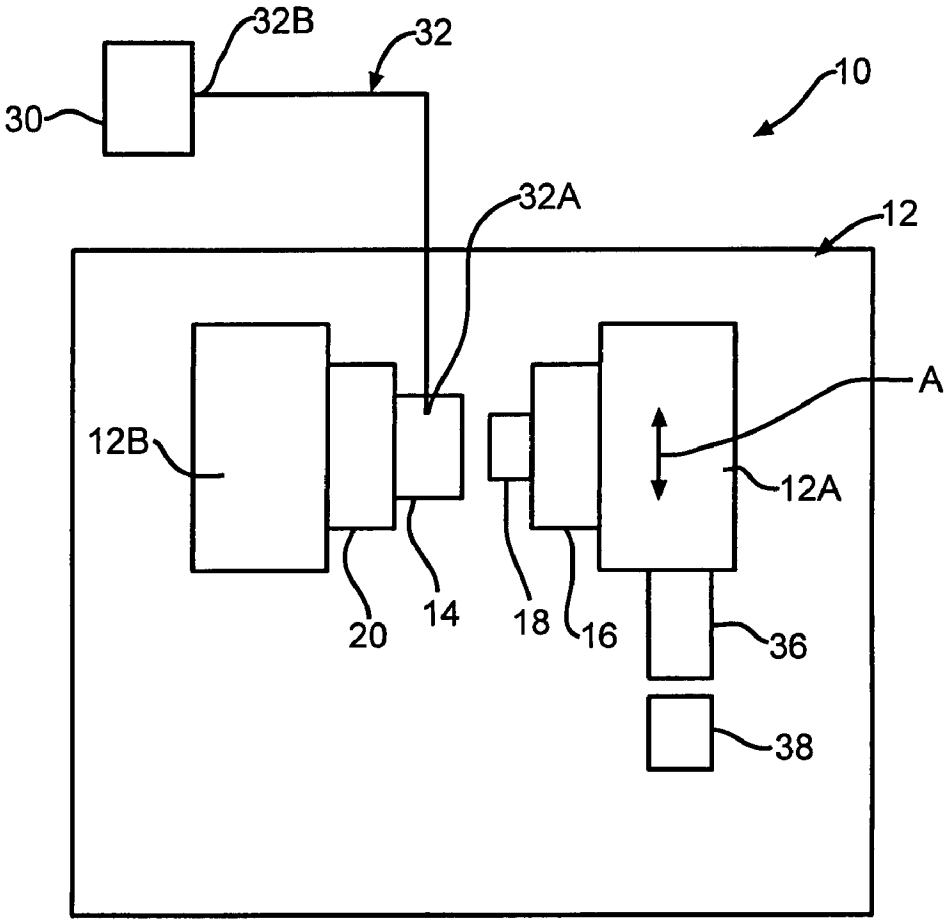
FIG. 3 a schematic diagram of a second embodiment of a rim rolling apparatus in accordance with the present invention.
Figure 4:
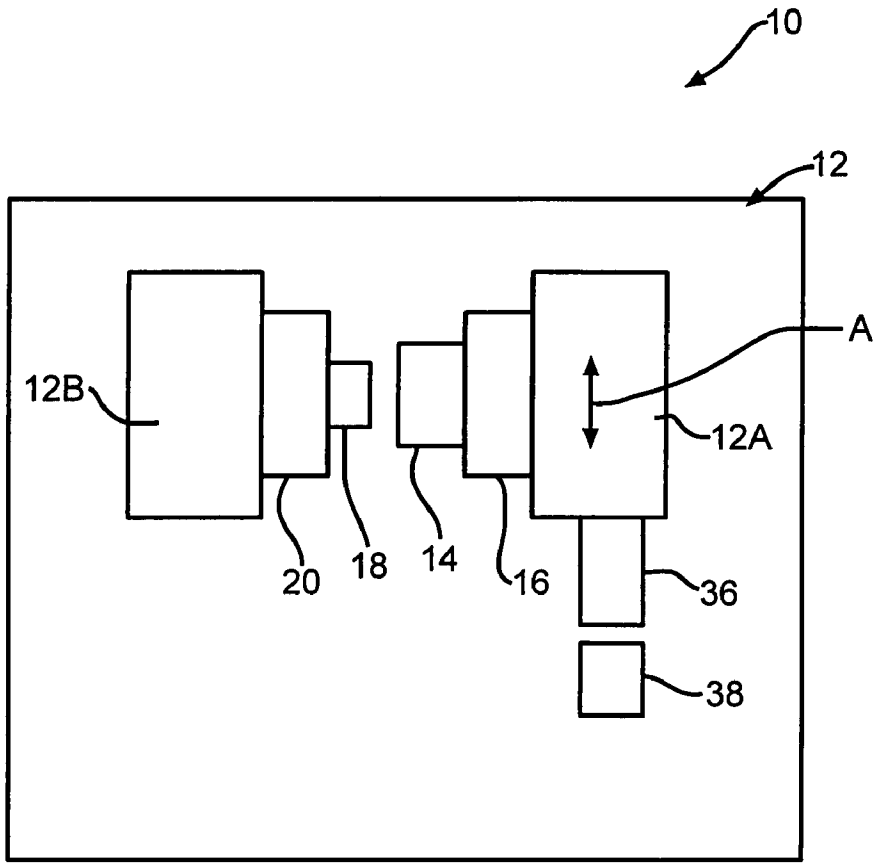
FIG. 4 a schematic diagram of a third embodiment of a rim rolling apparatus in accordance with the present invention.

Referring now to the drawings, there is illustrated in FIG. 1 a portion of a vehicle wheel rim rolling apparatus, indicated generally at 10, constructed in accordance with the present invention. The general structure and operation of the rim rolling apparatus is conventional in the art and only those portions necessary for understanding the present invention will be discussed. The rim rolling apparatus 10 can be used to make a wheel rim (not shown) out of any suitable material, such as for example, steel or aluminum or alloys thereof, for use in producing a fabricated type of vehicle wheel, such as for example, a "well attached" vehicle wheel, (such as shown in FIG. 3 of U.S. Pat. No. 5,533,261 to Kemmerer), a "full face" vehicle wheel, (such as shown in FIG. 5A of U.S. Pat. No. 5,533,261 to Kemmerer), a "bead seat attached" vehicle wheel (such as shown in FIG. 4 of U.S. Pat. No. 5,188,429 to Heck et al.), or a "modular wheel" construction including a partial rim and a full face wheel disc (such as shown in U.S. Pat. No. 5,360,261 to Archibald et al.), all of these patents incorporated by reference in entirety herein.

Figure 2:
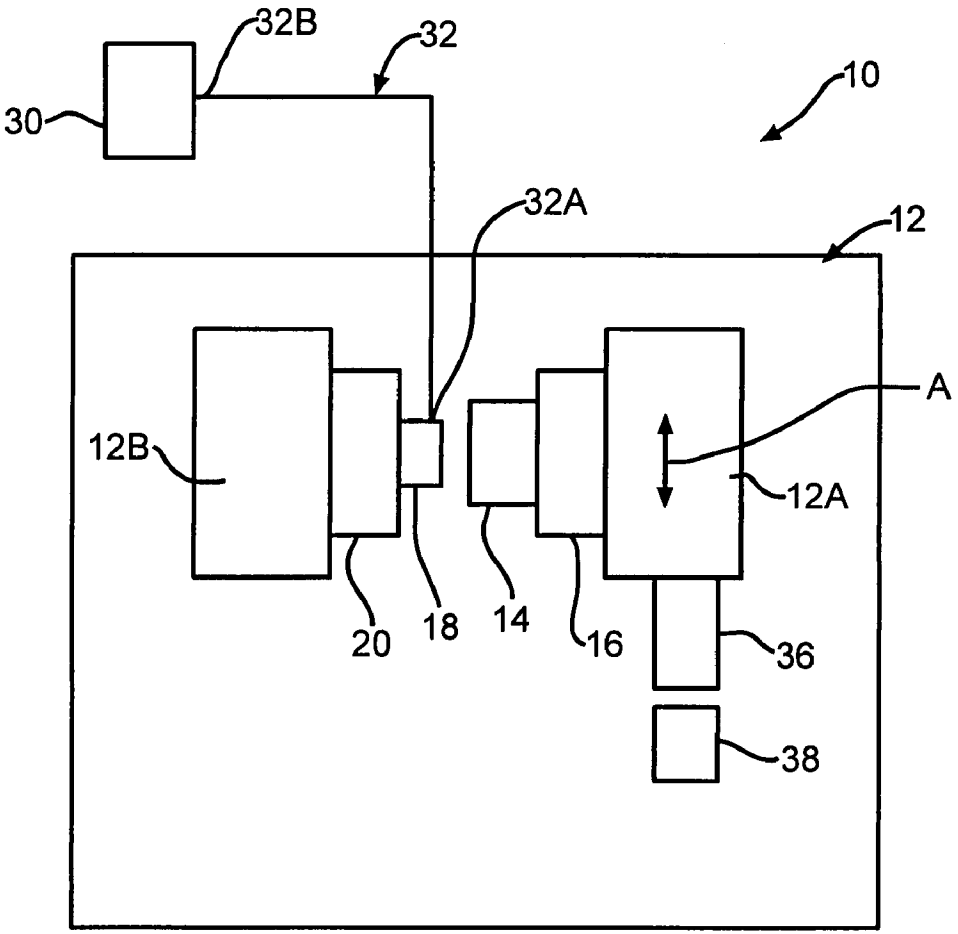
FIG. 2 is a schematic diagram of the rim rolling apparatus according to the first embodiment of the present invention illustrated in FIG. 1.

The illustrated wheel rim rolling apparatus 10 includes a top roll assembly, indicated generally at 12. The top roll assembly 12 includes upper rim tools (shown schematically at 36 in FIG. 2), which engage a rim blank or a partially formed rim (shown schematically at 38 in FIG. 2), in order to impart a desired shape thereto. The top roll assembly 12 moves in a generally vertical direction with each cycle of the apparatus 10 to a desired position to locate the associated upper rim tools at a desired position with respect to the partially formed wheel rim.

To accomplish this in accordance with the present invention, the wheel rim rolling apparatus 10 includes a first member 14 and a second member 18 which as will be discussed below are operative to indicate the position of a moveable member of the top roll assembly 12. In the illustrated embodiment, the first member 14 is a scale which is attached to a moveable member 12A of the top roll assembly 12 by a first bracket 16 (the moveable member 12A being moveable generally vertically in the direction of arrow A), and the second member 18 is a reader head which is attached to a non-moveable member 12B of the top roll assembly 12 by a second bracket 20. In this embodiment, the first bracket 16 is welded to the moveable member 12A of the top roll assembly 12, and the second bracket 20 is welded to the non-moveable member 12B of the top roll assembly 12. Alternatively, one or both of the scale 14 and the reader head 18 can be secured to the top roll assembly 12 by other suitable means if so desired. However, as will be discussed below, according to the present invention, the first member 14 is attached to the moveable member 12A which carries or supports the upper rim tools 36 so that the movement of the scale 14 corresponds to the movement of the upper rim tools 36.

The scale 14 can be any suitable scale, such as a Spherosyn Model No. S50115200 digital scale, manufactured by Newell Measurement Systems, Ltd., of Leicester, England. The reader head 18 can be any suitable reader head, such as a Spherosyn Model No. SHG01009D025 digital reader head, manufactured by Newell Measurement Systems, Ltd, of Leicester, England. Alternatively, one or both of the first member 14 and the second member 18 can be other than described if so desired. Thus, if desired, only two components or members need be used to accurately determine the position of the upper rim tools 36 of the top roll assembly 12.

In the illustrated embodiment, the reader head 18 is connected via a conduit 32 to an indicating member 30. To accomplish this, the conduit 32 includes a first end 32A operatively connected to the reader head 18 and an opposite second end 32B (shown in FIG. 2), operatively connected to the indicated member 30. Preferably, the indicating member 30 is a visual readout display 30. The readout display 30 is preferably a suitable digital readout display, such as a Spherosyn Model No. SA100 single axis digital readout display, manufactured by Newell Measurement Systems, Ltd, of Leicester, England. Alternatively, other suitable readouts can be used if so desired. The conduit 32 is preferably a suitable conduit, such as a Spherosyn Model No. ELD00015 cable extension, manufactured by Newell Measurement Systems, Ltd, of Leicester, England. Alternatively, other suitable conduits can be used if so desired. Alternatively, the structure of the wheel rim rolling apparatus 10 and/or the top roll assembly 12 can be other than illustrated if so desired. For example, the scale 14 could be attached to the non-moveable member 12B and the reader head 18 could be attached to the moveable member 12A if so desired. Also, one or both of the scale 14 and the reader head 18 could be replaced with other kinds of devices which are capable of providing the position of the moveable member 12A, and therefore the upper rim tools 36. For example, the scale 14 could be replaced with a scale having readable indicia thereon (shown schematically in FIG. 4 at 14) and the reader head 18 could be replaced with a line or other indicating device (shown schematically in FIG. 4 at 18) which can be used to indicate the position of the moveable member 12A and therefore, the position of the upper rim tools 36. Additionally, the first member 14 and the second member 18 can be of such a design that these two components are only used to indicate the position of the upper rim tools 36 of the top roll assembly 12 of the vehicle wheel rim rolling apparatus 10.

In operation, since the scale 14 is attached to the moveable member 12A of the top roll assembly 12 which supports the upper rim tools 36 and the reader head 18 is attached to the non-moveable member 12B of the top roll assembly 12, as the upper rim tools 36 move, and therefore the moveable member 12A, the scale 14 moves relative to the reader head 18 and via the cable extension 32, the readout display 30 displays a number indicating the relative position of the moveable member 12A of the top roll assembly 12, and therefore the relative position of the upper rim tools 36, via the position of the scale 14 with respect to the reader head 18, of the top roll assembly 12.

Referring now to FIG. 3 and using like reference numbers to indicate corresponding parts, there is illustrated schematically a second embodiment of a vehicle wheel rim rolling apparatus, indicated generally at 10, constructed in accordance with the present invention. In this embodiment, the first member 14 is attached to the non-moveable member 12B of the top roll assembly 12 by the bracket 20 and the second member 18 is attached to the movable member 12A of the top roll assembly 12 by the bracket 16.

One advantage of the present invention is that because the first member 14 (or in an alternate embodiment the second member 18), is attached to the moveable member 12A of the top roll assembly 12 which carries the upper rim tools 36, an accurate measurement of the position of the upper rim tools 36 can be obtained. Also, the first member 14 and the second member 18 are operative to provide a better repeatability of the measurement of the position of the associated members 12A and 12B of the top roll assembly 12. In addition, the first member 14 and the second member 18 are operative to reduce the set up time during part changeover. Further, the first member 14 and the second member 18 are operative to provide a "zero set" function. Also, the first member 14 and the second member 18 are operative to provide a convenient way to check the operating characteristics of the operating stroke of the associated hydraulic cylinders of top roll assembly 12.

In accordance with the provisions of the patent statutes, the principle and mode of operation of this invention have been described and illustrated in its preferred embodiment. However, it must be understood that the invention may be practiced otherwise than as specifically explained and illustrated without departing from the scope or spirit of the attached claims.

What is claimed is:

1. A wheel rim rolling apparatus comprising:

a top roll assembly having upper rim tools adapted to engage a rim blank or a partially formed rim in order to impart a desired shape thereto, a moveable member and a non-moveable member, the upper rim tools being carried by the moveable member;

a first position indicating member attached to one of the moveable member and the non-moveable member of the top roll assembly, the first position indicating member operative to generate a visual or readable output signal which is used for determining the position of the upper rim tools of the top roll assembly; and a second position receiving member attached to the other one of the moveable member and the non-moveable member of the top roll assembly, the second position receiving member having an internal passage formed therein for receiving at least a portion of the first position indicating member for guided movement relative thereto, such that when the moveable member moves relative to the non-moveable member the second position receiving member receives the visual or readable output signal from the first position indicating member to thereby indicate the position of the upper rim tools.

2. The wheel rim rolling apparatus of claim 1 wherein the first position indicating member is attached to the moveable member and the second position receiving member is attached to the non-moveable member.

3. The wheel rim rolling apparatus of claim 1 wherein the first position indicating member is attached to the non-moveable member and the second position receiving member is attached to the moveable member.

4. The wheel rim rolling apparatus of claim 1 wherein the first position indicating member is a digital scale and the second position receiving member is a digital reader head.

5. The wheel rim rolling apparatus of claim 4 further including a digital readout display operatively connected to the digital reader head.

6. The wheel rim rolling apparatus of claim 1 wherein the first position indicating member is attached to the moveable member, the second position receiving member is attached to the non-moveable member, and the indicating member is operatively coupled to the first position indicating member.

7. The wheel rim rolling apparatus of claim 1 wherein the first position indicating member is attached to the moveable member, the second position receiving member is attached to the non-moveable member, and the indicating member is operatively coupled to the second position receiving member.

8. The wheel rim rolling apparatus of claim 1 wherein the first position indicating member is attached to the non-moveable member, the second position receiving member is attached to the moveable member, and the indicating member is operatively coupled to the first position indicating member.

9. The wheel rim rolling apparatus of claim 1 wherein the first position indicating member is attached to the non-moveable member, the second position receiving member is attached to the moveable member, and the indicating member is operatively coupled to the second position receiving member.

10. A wheel rim rolling apparatus comprising:

a top roll assembly having upper rim tools adapted to engage a rim blank or a partially formed rim in order to impart a desired shape thereto, a moveable member and a non-moveable member, the upper rim tools being carried by the moveable member;

a first position indicating member attached to one of the moveable member and the non-moveable member of the top roll assembly, the first position indicating member operative to generate a visual or readable output signal which is used for determining the position of the upper rim tools of the top roll assembly;

a second position receiving member attached to the other one of the moveable member and the non-moveable member of the top roll assembly, the second position receiving member having an internal passage formed therein for receiving at least a portion of the first position indicating member for guided movement relative thereto, such that when the moveable member moves relative to the non-moveable member the second position receiving member receives the visual or readable output signal from the first position indicating member to thereby indicate the position of the upper rim tools; and an indicating member operatively coupled to the second position receiving member for providing a visual or readable of the position of the upper rim tools of the top roll assembly.

11. The wheel rim rolling apparatus of claim 10 wherein the first position indicating member is a digital scale, the second position receiving member is a digital reader head, and the indicating member is a digital readout display.

12. A wheel rim rolling apparatus comprising:

a top roll assembly having upper rim tools adapted to engage a rim blank or a partially formed rim in order to impart a desired shape thereto, a moveable member and a non-moveable member, the upper rim tools being carried by the moveable member;

a first position indicating member attached to one of the moveable member and the non-moveable member of the top roll assembly, the first position indicating member operative to generate an output signal which is used for determining the position of the upper rim tools of the top roll assembly;

a second position receiving member attached to the other one of the moveable member and the non-moveable member of the top roll assembly, the second position receiving member having an internal passage formed therein for receiving at least a portion of the first position indicating member for guided movement relative thereto, such that when the moveable member moves relative to the non-moveable member the second position receiving member receives the output signal from the first position indicating member to thereby indicate the position of the upper rim tools.

13. The wheel rim rolling apparatus of claim 12 further including an indicating member operatively coupled to the second position receiving member for indicating the position of the upper rim tools of the top roll assembly.

14. The wheel rim rolling apparatus of claim 12 wherein the first position indicating member is attached to the moveable member and the second position receiving member is attached to the non-moveable member.

15. The wheel rim rolling apparatus of claim 12 wherein the first position indicating member is attached to the non-moveable member and the second position receiving member is attached to the moveable member.

16. The wheel rim rolling apparatus of claim 12 wherein the first position indicating member is a digital scale and the second position receiving member is a digital reader head.

17. The wheel rim rolling apparatus of claim 16 further including a digital readout display operatively connected to the digital reader head.

* * * * *